United States Patent [19]

Johnson

[11] 4,316,644

[45] Feb. 23, 1982

[54] MODULAR CONTAINER

[75] Inventor: Jerry L. Johnson, Potrero, Calif.

[73] Assignee: Landes Manufacturing Company, Los Angeles, Calif.

[21] Appl. No.: 86,699

[22] Filed: Oct. 22, 1979

[51] Int. Cl.[3] ..... A47B 87/00

[52] U.S. Cl. ..... 312/108; 312/111; 312/213; 312/6; 248/99

[58] Field of Search ..... 312/108, 111, 3, 4, 312/5, 6, 213, 107, 257 SK, 257 SM, 257 A; 248/99; 297/441

[56] References Cited

U.S. PATENT DOCUMENTS

| | | | |
|---|---|---|---|
| 315,760 | 4/1885 | Garrison | 312/5 |
| 1,012,045 | 12/1911 | Adams | 248/99 |
| 1,076,116 | 10/1913 | Hatfield | 312/111 |
| 1,252,816 | 1/1918 | Kuehl | 312/107 |
| 1,271,083 | 7/1918 | Schaffert | 312/107 |
| 1,292,946 | 1/1919 | Yawman | 312/108 |
| 1,312,336 | 8/1919 | McNaughton | 248/99 |
| 1,329,616 | 2/1920 | Larson | 312/107 |
| 1,994,159 | 3/1935 | Wurzburg | 312/108 |
| 2,107,828 | 2/1938 | Krantz | 312/6 |
| 2,172,266 | 9/1939 | Whitaker | 312/213 |
| 2,474,597 | 6/1949 | Shwarzowsky | 297/441 |
| 2,723,484 | 11/1955 | Nelson, Jr. | 312/11 |
| 3,257,090 | 6/1966 | Frazier | 248/99 |
| 3,288,301 | 11/1966 | Kent et al. | 312/108 |
| 3,353,888 | 11/1967 | Pritelli, Jr. | 312/111 |
| 3,675,981 | 7/1972 | Mallander | 312/6 |
| 4,118,089 | 10/1978 | Johnson et al. | 312/3 |

FOREIGN PATENT DOCUMENTS

| | | | |
|---|---|---|---|
| 1382284 | 1/1975 | United Kingdom | 312/111 |

*Primary Examiner*—Victor N. Sakran

*Attorney, Agent, or Firm*—William W. Haefliger

[57] ABSTRACT

A container for use as furniture comprises:

(a) a framework defining multiple side areas, a top area and a bottom area, the framework including at least one elongated member, (b) a first flexible sheet adapted to cover at least part of one of said areas, and (c) and a first retainer attached to one elongated portion of said sheet, the retainer and said one member having tongue and groove interconnection, whereby the sheet is retained to said framework.

3 Claims, 6 Drawing Figures

MODULAR CONTAINER

BACKGROUND OF THE INVENTION

This invention relates generally to furniture construction, and more particularly, concerns a container or cabinet which occupies minimum space for shipment or storage, which consists of a few simple components which are readily assembled and disassembled, and which may incorporate a drawer in the form of a basket which is removable for cleaning or replacement.

There is a constant need for furniture which is attractively designed and characterized as occupying minimum space for shipment or storage as in kit form, which may be quickly assembled by the user, and which is sturdy and durable. These requirements are not easily met in the case of cabinets with drawers, since cabinets and drawers are box-like and not readily capable of being collapsed.

SUMMARY OF THE INVENTION

It is a major object of the invention to provide a simple, sturdy container or cabinet which is characterized as meeting the needs and requirements and having the advantages and described above. The container is cooperable with a basket drawer, and basically comprises:

(a) a framework defining multiple side areas, a top area and a bottom area, the framework including at least one elongated member, (b) a first flexible sheet adapted to cover at least part of one of said areas, and (c) and a first retainer attached to one elongated portion of said sheet, the retainer and said one member having tongue and groove interconnection, whereby the sheet is retained to said framework.

As will be seen, the framework typically includes multiple of such members, which have multiple functions. Among these are the flush retention of flexible side panels; the interconnection of parallel metallic loops; the edge support of cover or slot elements; the provision of support slides for rails on a basket frame, allowing the basket to be moved in and out of the container in the manner of a drawer. As a result a simple, sturdy, easily assembled, multiple function, lightweight and inexpensive cabinet or container is provided.

A further object is to provide an article of furniture in the form of a cube, the article including (a) a framework including two lengthwise elongated parallel members at opposite sides of the cube, (b) each of said members having a first lengthwise elongated groove formed in the outer side thereof, to receive a side panel support, (c) each of said members having a lengthwise elongated recess formed in the inner side thereof to receive a drawer slide, (d) each of said members having a second lengthwise elongated groove formed in the inner side thereof and opening at the top of said member to receive an edge portion of a cover element, (e) said first and second grooves located respectively below and above the level of said recess.

Side panels may optionally be attached to the cube, via the first grooves; or a drawer may optionally be received in the cube and supported by slides received in the recesses; or a cover element or elements may be supported by the parallel members as via edge portions received in the second grooves; or various of these options may be combined in the cube, as facilitated by the described parallel members.

These and other objects and advantages of the invention, as well as the details of an illustrative embodiment, will be more fully understood from the following description and drawings, in which:

DRAWING DESCRIPTION

DETAILED DESCRIPTION

Figure 1:
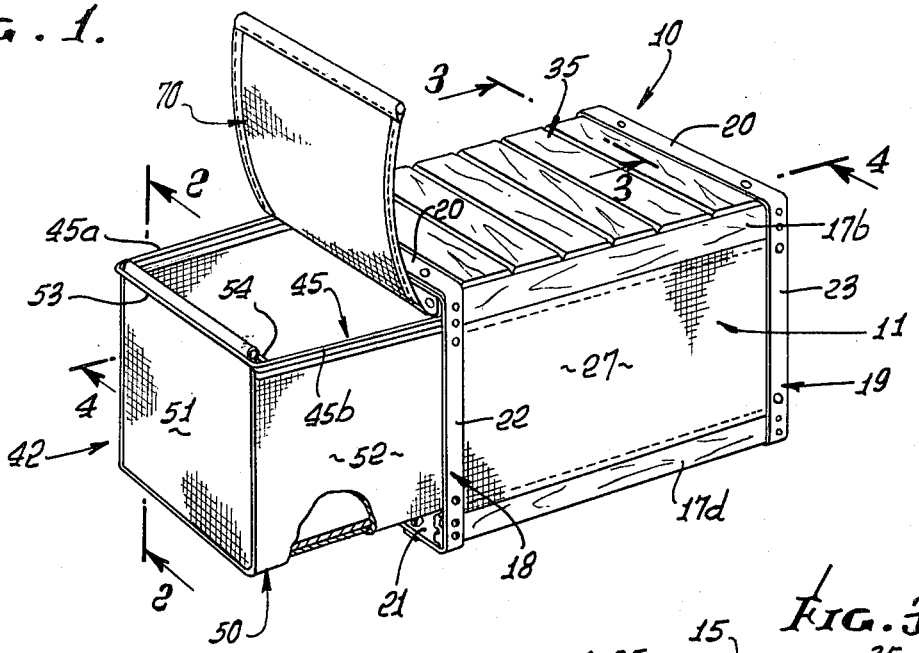
FIG. 1 is a perspective view of a container embodying the invention.

In the drawings, a modular container or cabinet 10 has a framework defining multiple side areas (right side area 11, left side area 12, front side area 13 and rear side area 14) a top area 15, and a bottom area 16. Thus, the container is in the form of a box. Also, the framework includes at least one, and typically four elongated members 17*a*, 17*b*, 17*c* and 17*d* which extent in parallel relation, forwardly and rearwardly, at the upper left and right, and lower left and right, corners of the container. Such members may be alike, may consist of wood, and have the construction as further shown in FIG. 4.

Figure 3:
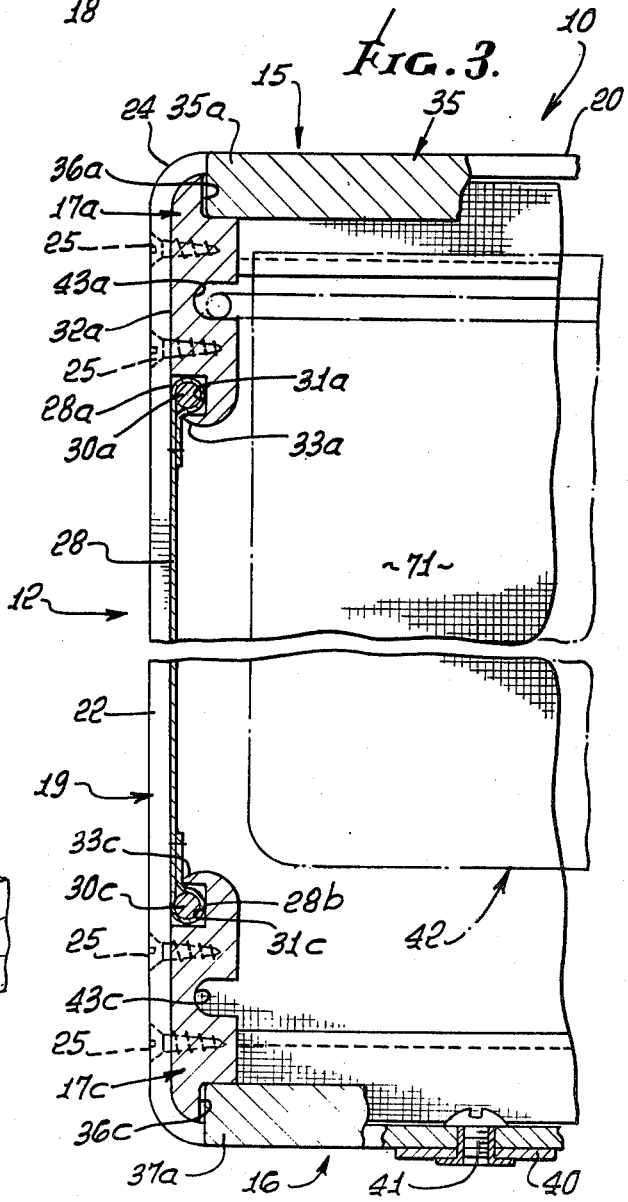
FIG. 3 is an enlarged horizontal and fragmentary section taken on lines 3—3 of FIG. 1.

For the sake of extreme strength and simplicity, the framework may also include two like, upright parallel, metallic loops 18 and 19 located respectively at the forward and rearward ends of the container. Each loop is generally rectangular (typically generally square), and having top and bottom horizontal stretches 20 and 21, and left and right upright stretches 22 and 23. The corners of the loops are typically rounded, as at 24. Wooden members 17*a* and 17*d* are joined to the inner sides of the loops as by screw fasteners 25, as best seen in FIG. 3. Thus, the members 17*a*–17*d* are protected against inadvertent damage, by the metallic loops which bound or extend about the ends of the members 17*a*–17*d*. The loops are substantially rigid, i.e. non-collapsible under normal loading.

Figure 6:
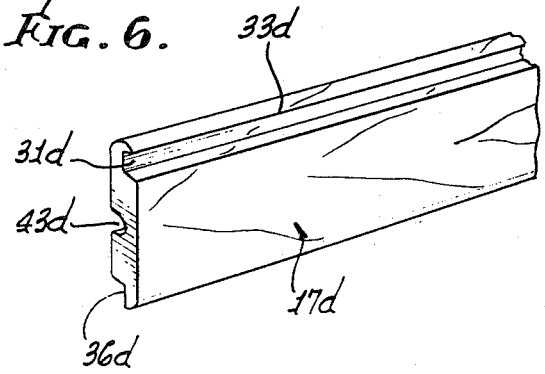
FIG. 6 is a fragmentary perspective showing a structural member.

It is a feature of the invention that a first flexible sheet is provided to cover at least part of one of the framework areas as referred to above. To this end, and as shown, like flexible sheets 27 and 28 are typically provided to cover the side areas 11 and 12 of the container. Such sheets may consist of decorative flexible plastic material sized to extend between the upper and lower members 17*a* and 17*c*, and upper and lower members 17*b* and 17*d*, respectively. It is a further feature of the invention that, as regards one such sheet, a first elongated retainer (as for example a dowel) is provided to attach the sheet to one of the members 17*a*–17*d*, the member and dowel having tongue and groove interconnection whereby the sheet is retained to the framework. Thus, for example in FIG. 3, and as regards sheet 28, the upper end portion thereof forms a loop 28*a* which closely receives elongated dowel 30*a* that dowel is closely or wedgably received in elongated groove 31*a* formed in lower portion of member 17*a*. Similarly, the lower end portion of sheet 28 forms a loop 28*b* which closely receives elongated dowel 30*c*, and that dowel is closely or wedgably received in elongated groove 31*c* formed in members 17*c*. Thereby both elongated upper and lower edge portions of sheet 28 are simply and effectively retained to the framework; however, the dowels may be removed from the grooves to facilitate removal of sheet 28, to leave side 12 open, if desired, without destroying the structural integrity of the container. The same dowel and groove construction is employed at the right side of the container, i.e. to connect sheet 27 to members 17*b* and 17*d*. See groove 31*d* in member 17*d*, for example, in FIG. 6. Grooves 31*a*–31*d* in members 17*a*–17*d* face toward the outer side of the container, and the outer surfaces 32*a*–32*d* of those members are generally parallel to the main extent of the sheets 28 and 29, and exposed, to form continuations of such sheets. Member edges 33*a*–33*d* are offset from the planes of such surfaces 32*a*–32*d* so that the outer surfaces of the associated sheets are co-planar with the member surfaces 32*a*–32*d*, as is clear from FIG. 3.

Figure 4:
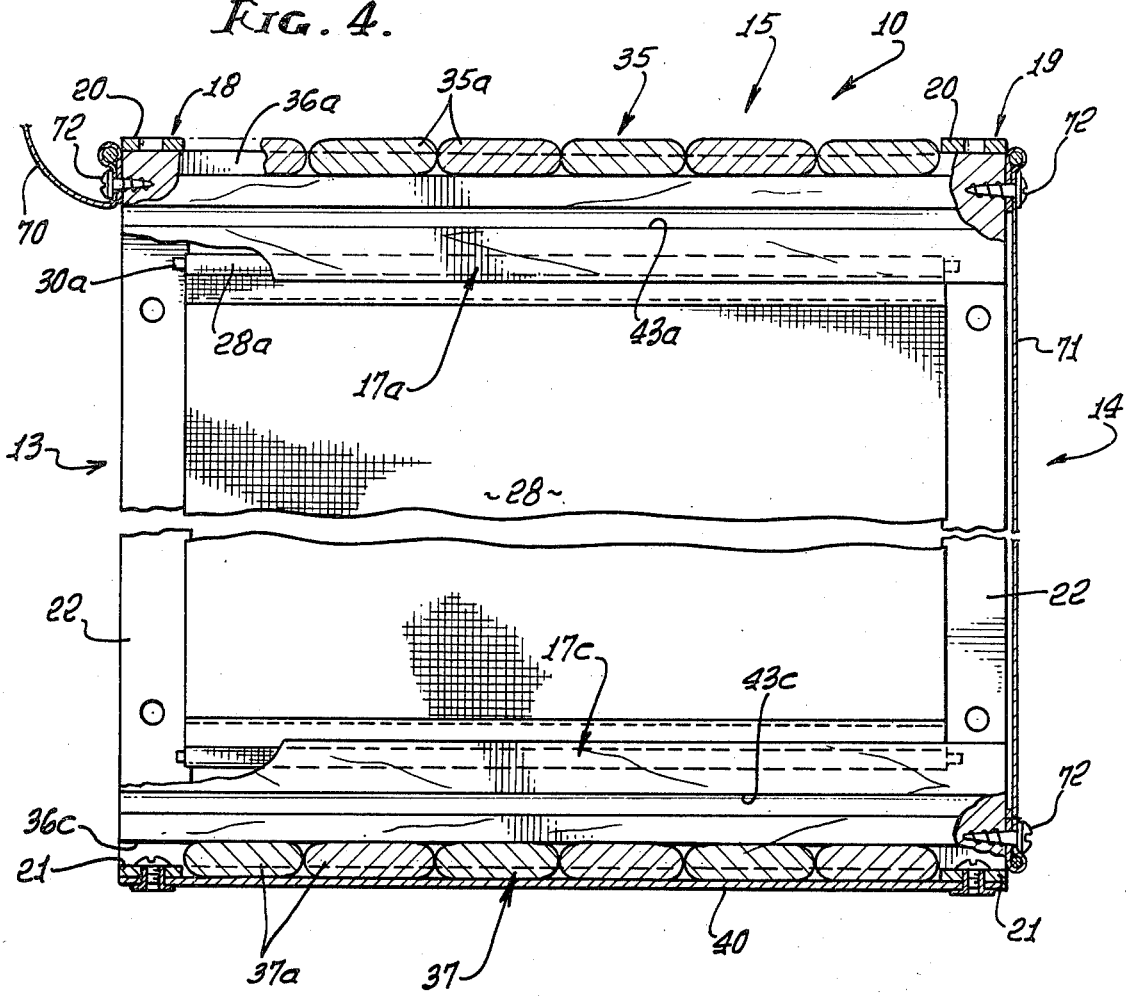
FIG. 4 is an enlarged vertical section taken on lines 4—4 of FIG. 1.

Each of the members 17*a*–17*d* also defines another groove, and at the opposite end of the member from the dowel groove, to receive the end of and cover means (as for example the ends of parallel cover slats). Thus, as seen in FIG. 4, ends 35*a* of top cover slats 35 are received in groove 36*a* formed in member 17*a*, and the ends 37*a* of bottom cover slats 37 are received in groove 36*c* formed in member 17*c*. Similar grooves are formed in members 17*b* and 17*d*, as for example is exemplified by grooves 36*d* in member 17*d* seen in FIG. 6. Note that grooves 36 are formed in the inner sides of the members, and grooves 31 are formed in the outer sides of those members. The lower slats may be retained in position by metallic straps 40 attached by fastener 41 to metallic loops 18 and 19, as seen in FIG. 4.

Figure 2:
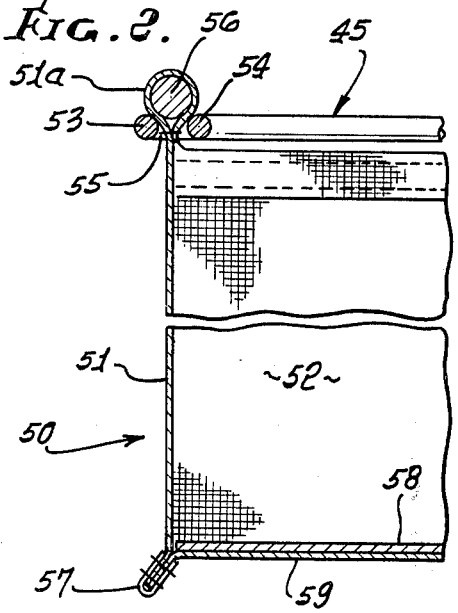
FIG. 2 is an enlarged vertical and fragmentary section taken on lines 2—2 of FIG. 1.

Members 17*a*–17*d* also have a fourth function, which is to provide support slides for a drawer 42 shown in FIG. 1. To this end, the respective member have grooves 43*a*–43*d* sunk in their inner sides, between the upper and lower grooves previously described, those grooves defining such parallel slides. The drawer may advantageously have the construction as shown in both FIGS. 1 and 2, with a generally rectangular metallic frame 45 defining parallel, metallic guide rails 45*a* and 45*b* spaced apart for slidable reception in the slide grooves of the uppermost members 17*a* and 17*b*. Note that the modular container may be inverted, and that the rails there being receivable in the slide grooves of the other two members (such as members 17*c* and 17*d*).

The drawer 42 also includes a basket indicated generally at 50, and having front rear walls 51 and side walls 52 hanging from the frame 45 whereby the basket may be collapsed upwardly toward a horizontal plane defined by the frame 45. The frame will be understood as defining slots through which upper tab portions of the basket walls are received from removable attachment to the frame. For this purpose, the frame 45 may with unusual advantage include, at each of its forward and rearward ends, parallel members 53 and 54 which are spaced apart to define a slot 55. Members 53 and 54 may be alike and interconnected by extension of rails 45*a* and 45*b* to form a continuous loop which is approximately square.

The tab portion 51*a* of the basket wall 51 is extended up through slot 55. A loop is formed by the tab portion and a retainer is extended lengthwise within the loop. The retainer may take the form of an elongated dowel 56 extending parallel to members 53 and 54. The dowel is diametrically larger than the slot, to block downward withdrawal of the loop through the slot, whereby the basket wall 51 is removably retained to the frame in a very simple manner. Front and rear walls 51 of the basket may be easily attached to the frame in this manner, and side walls 52 attached to walls 51, for suspension.

Reinforcement piping is indicated at 57 and attached to the basket material. Piping 57 extends peripherally about the lower portion of the basket within which a square stiffener panel 58 may be inserted and retained by the bottom wall 59. The basket may consist of lightweight, durable plastic to facilitate upward collapse. Also, such a drawer insert basket may easily be removed from the frame, for cleaning or replacement. The container may be used with the basket removed, since slots 37 then form the bottom wall of the container.

Figure 5:
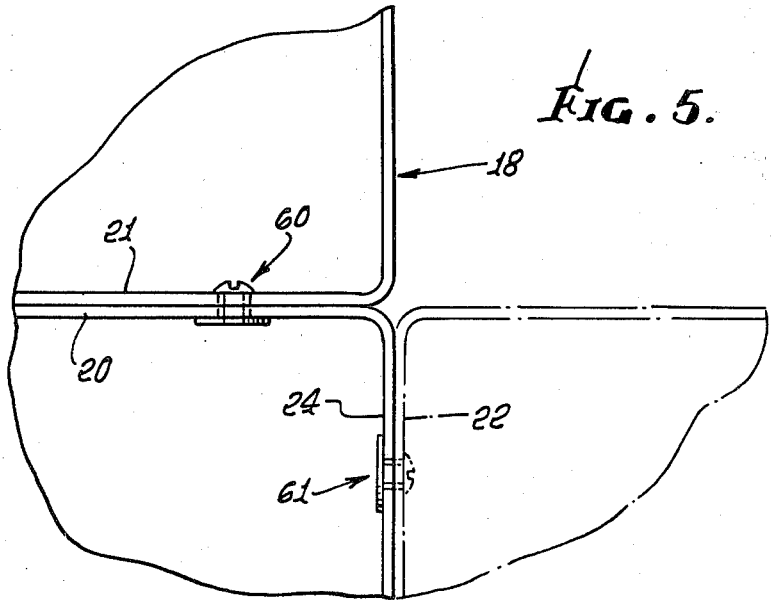
FIG. 5 is a fragmentary elevation showing the manner in which multiple of the modular container may be interconnected.

Finally, the frameworks of two or more containers are connectible to form a connected group of containers or cabinets. For this purpose, fastener 60 may be used to overlying stretches of the loops 18 and 19 of upper and lower containers and fastener 61 may be used to interconnect vertically adjacent stretches of side-by-side container, as seen in FIG. 5.

Also, front and rear flexible, decorative cover flaps 70 and 71 may be attached to the members 17*a* and 17*b*, as at 72, to cover front and rear areas 13 and 14, as desired. Such flaps are easily removed, if desired.

I claim

1. A container comprising, in combination, (a) a framework including two generally rectangular metallic loops and four elongated parallel members interconnecting said loops to define a cube-like module having multiple side areas, a top area and a bottom area, the loops having inner sides to which outer sides of said members are attached, (b) means associated with the framework to cover certain of said areas, (c) two of said elongated parallel members defining elongated support slides, (d) a drawer having a generally rectangular movable frame defining parallel peripheral guide rails for cooperation with said support slides whereby the drawer may be advanced and retracted relative to said framework, and (e) the drawer including a basket having flexible walls supported by and hanging from said movable frame, whereby the basket may be collapsed upwardly toward a plane defined by the movable frame, said basket and said movable frame having a retracted position substantially entirely confined within an interior zone bounded by said framework defined multiple side areas, top area and bottom area, (f) each of said members defining an elongated groove spaced from said slide and including relatively stiff cover means interfitting said grooves and confined by said members.

2. The combination of claim 1 wherein said cover means comprises elongated slats extending generally normal to said grooves which receive end portions of the slats.

3. The container of claim 1 and including a second container like the first mentioned container, the metallic loops of the two containers being interconnected.

* * * * *